US007516862B2

(12) United States Patent
McDonough

(10) Patent No.: US 7,516,862 B2
(45) Date of Patent: Apr. 14, 2009

(54) STRAW DRINKING CUP

(75) Inventor: Justin F. McDonough, Van Nuys, CA (US)

(73) Assignee: Munchkin, Inc., North Hills, CA (US)

( * ) Notice: Subject to any disclaimer, the term of this patent is extended or adjusted under 35 U.S.C. 154(b) by 43 days.

(21) Appl. No.: 11/058,940

(22) Filed: Feb. 16, 2005

(65) Prior Publication Data

US 2005/0133519 A1 Jun. 23, 2005

Related U.S. Application Data

(62) Division of application No. 10/637,228, filed on Aug. 8, 2003, now abandoned.

(51) Int. Cl.
*B65D 83/00* (2006.01)
*B65D 47/08* (2006.01)

(52) U.S. Cl. ..... 215/229; 215/388; 220/705; 220/708

(58) Field of Classification Search ..... 220/705, 220/706, 707, 708, 709, 710, 714; 222/527, 222/532, 528, 533, 529, 534, 530, 535, 531, 222/536, 537, 525, 563; 215/388, 229
See application file for complete search history.

(56) References Cited

U.S. PATENT DOCUMENTS 15,192 A * 6/1856 Peale ..... 137/844
1,309,994 A * 7/1919 McAuliffe ..... 215/11.1
3,291,331 A * 12/1966 Grisham et al. ..... 215/388
3,438,527 A * 4/1969 Gamblin, Jr. ..... 215/388
5,038,476 A * 8/1991 McCrea ..... 30/141
5,203,468 A * 4/1993 Hsu ..... 220/254.3
5,273,172 A 12/1993 Rossbach et al.
5,465,866 A * 11/1995 Belcastro ..... 220/709
5,484,080 A * 1/1996 Blasnik et al. ..... 220/708
D366,809 S 2/1996 Green
5,897,013 A * 4/1999 Manganiello ..... 220/252
6,116,446 A * 9/2000 Haughton et al. ..... 215/355
6,276,560 B1 * 8/2001 Belcastro ..... 220/709
6,609,624 B2 * 8/2003 Goto et al. ..... 220/259.1
2002/0040909 A1 * 4/2002 Goto et al. ..... 220/709
2004/0069783 A1 * 4/2004 Chen ..... 220/254.3

FOREIGN PATENT DOCUMENTS

JP 2001-300 A * 1/2001

* cited by examiner

*Primary Examiner*—Tri M Mai
(74) *Attorney, Agent, or Firm*—Knoble, Yoshida & Dunleavy, LLC

(57) ABSTRACT

A straw drinking cup includes a container and a flexible straw having a first, drinking, end and a second and that is disposed within the container. Advantageously, the cup includes a straw positioning mechanism that ensures that the first, drinking end of the flexible straw will remain upwardly oriented to minimize the possibility of leakage, regardless of whether the straw positioning mechanism is in the open position, the closed position, or in transit between the two positions. The straw drinking cup further includes an advantageous venting mechanism that includes a flexible membrane that permits air to flow into the container only when a sufficient pressure differential is developed across the membrane, such as will occur when a consumer is sucking on the flexible straw. The venting mechanism further operates so as to prevent leakage from the container, as sufficient pressure will not exist to draw any liquid across the flexible membrane.

12 Claims, 5 Drawing Sheets

STRAW DRINKING CUP

This is a divisional of prior application Ser. No. 10/637,228 filed on Aug. 8, 2003, now abandoned.

BACKGROUND OF THE INVENTION

1. Field of the Invention

This invention relates broadly to sealed drinking containers for serving beverages, especially to small children and individuals who are disabled. More specifically, this invention relates to an improved straw drinking cup of the type including a closed container and a flexible straw that is in communication with an interior of the container.

2. Description of the Related Technology

A number of straw drinking cups are commercially available and described in the patent literature. For example, U.S. Pat. No. 5,273,172 to Rossbach et al. describes a straw drinking cup that includes a pivotally movable cap that will contact, deflect, bend and cover a flexible drinking straw when it is closed. In order to permit replacement air to enter the cup during drinking, a separate borehole is defined in the cap of the Rossbach et al. design. A similar design is disclosed in U.S. Pat. No. 5,897,013 to Manganiello, which includes supplemental structure for correctly orienting the rotational position of the flexible drinking straw.

One problem that tends to afflict conventional straw drinking cups is leakage of the beverage that commonly occurs from the flexible drinking straw and from the container itself. Leakage from the container typically occurs through the venting holes that are provided to allow replacement air into the container during drinking. Leakage from the flexible drinking straw typically will occur as the straw is bent over during the closing of the cap. As the drinking end of the straw becomes inverted and points downwardly, residual liquid that is in the straw will of course tend to flow downwardly and leak onto the cap structure. Besides being messy and unsightly, such leakage may contribute to bacterial colonization in the affected area.

A need exists for an improved straw drinking cup design that is less susceptible to leakage during use.

SUMMARY OF THE INVENTION

Accordingly, it is an object of the invention to provide an improved straw drinking cup design that is less susceptible to leakage during use.

In order to achieve the above and other objects of the invention, a straw drinking cup that is constructed according to a first aspect of the invention includes a container; a flexible straw having a first end and a second end; and a straw positioning mechanism for positioning the flexible straw with respect to the container, the straw positioning mechanism being movable between a first operative position wherein the first end of said flexible straw is presented for sipping by a consumer and a second storage position, and wherein the straw positioning mechanism is constructed and arranged so that the first end of the flexible straw is upwardly oriented when in the second storage position, whereby spillage from the first end of the flexible straw is minimized.

According to a second aspect of the invention, an apparatus for serving a beverage includes a container; a first passage in communication with the container for serving a beverage from the container; a second, venting, passage that is in communication with the container; and a flexible membrane interposed in the second passage, the flexible membrane being constructed and arranged to permit air to flow through the second passage when a predetermined pressure differential is developed across the flexible membrane.

According to a third aspect of the invention, a straw drinking cup includes a container; a flexible straw having a first end and a second end, the flexible straw having an integral valve defined therein; and a straw positioning mechanism for positioning the flexible straw with respect to the container, the straw positioning mechanism being movable between a first operative position wherein the first end of the flexible straw is presented for sipping by a consumer and a second storage position.

According to a fourth aspect of the invention, a flexible straw assembly includes a flexible straw having a first end and a second end, an outer wall and an inner wall defining a lumen; and an integral valve positioned within said flexible straw for impeding fluid flow through said lumen unless a pressure differential is applied thereto.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
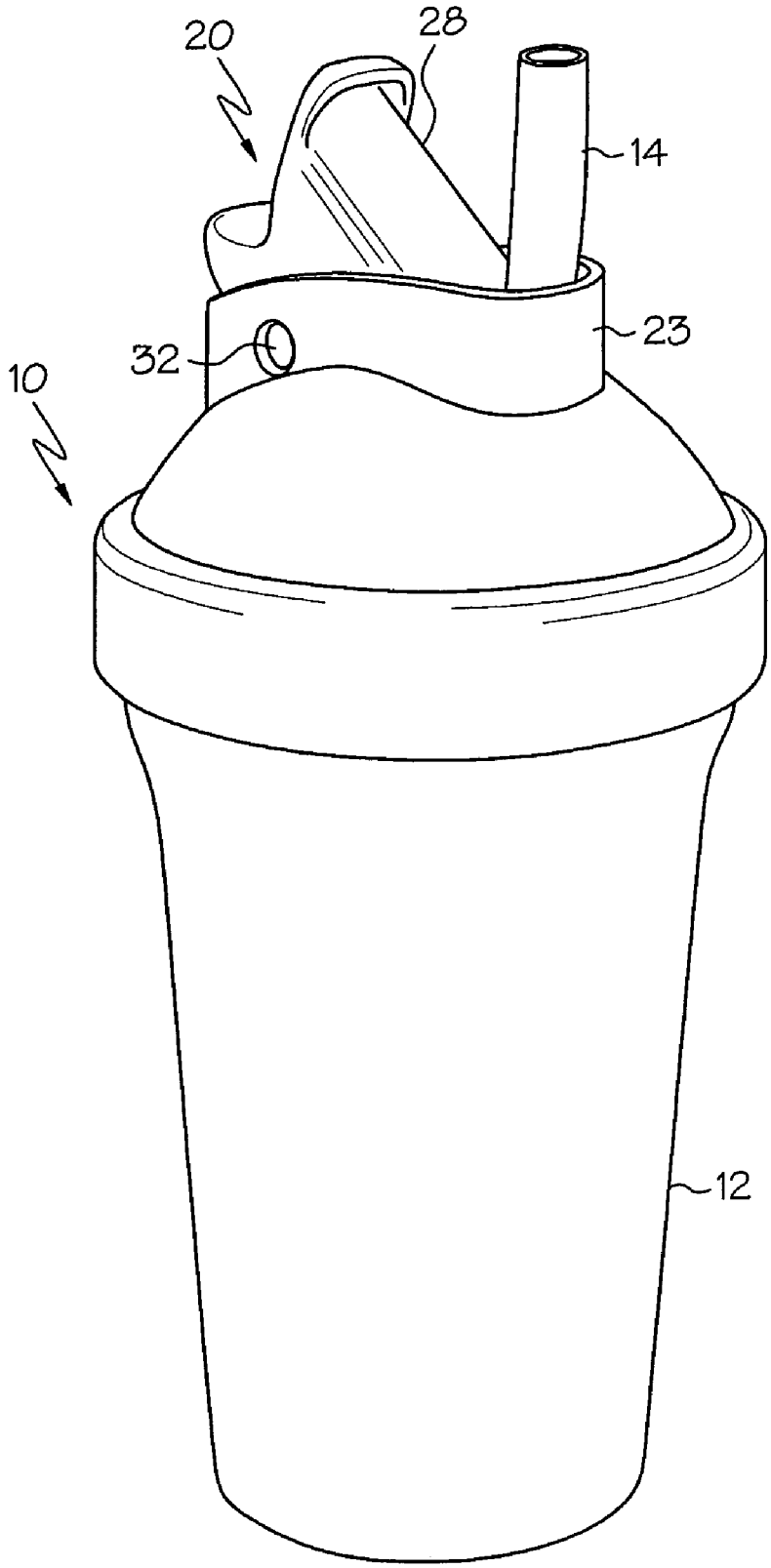
FIG. 1 is a perspective view of a straw drinking cup that is constructed according to a preferred embodiment of the invention.
Figure 2:
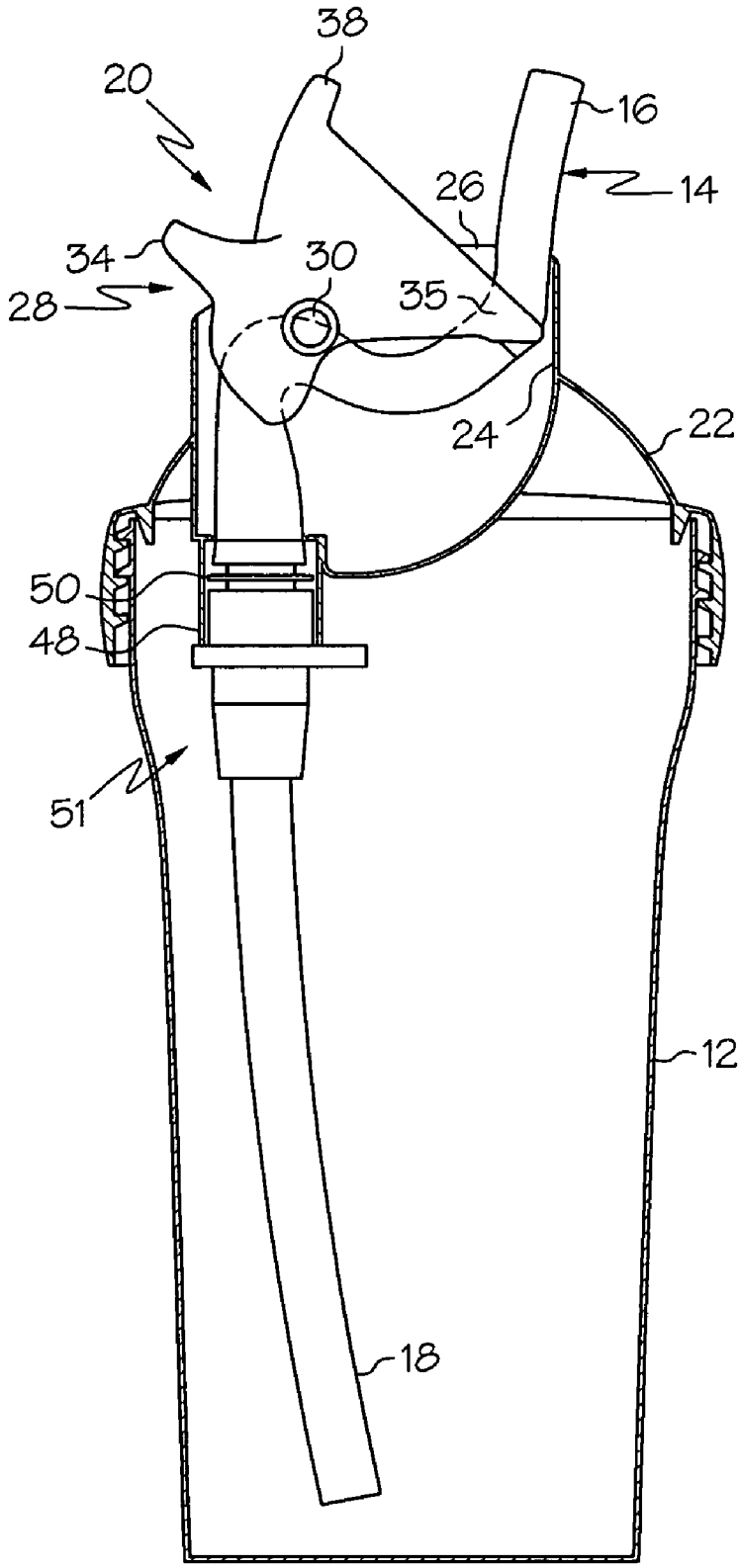
FIG. 2 is a partial cross-sectional view of the straw drinking cup shown in FIG. 1, shown in a first operational position.

Referring now to the drawings, wherein like reference numerals designate corresponding structure throughout the views, and referring in particular to FIG. 1, a straw drinking cup 10 that is constructed according to a preferred embodiment of the invention includes a container 12 and a flexible elastomeric straw 14 having a first, drinking end 16 and a second end 18 that is positioned within the container 12, as shown in FIG. 2. Straw drinking cup 10 further includes a straw positioning mechanism 20 for positioning the flexible straw 14 with respect to the container 12 between a first drinking position, shown in FIG. 2, and a second storage position, shown in FIG. 3. Most advantageously, and as will be described in greater detail below, the straw positioning mechanism 20 is constructed and arranged so that the first end 16 of the flexible straw 14 is upwardly oriented in the second storage position, and furthermore remains upwardly oriented during the entire range of movement between the first drinking position and the second storage position. Accordingly, liquid within the flexible straw 14 will not at any point be induced to flow downwardly out of the drinking end 16 to become trapped at any location in the drinking cup 10.

Referring now to FIG. 2, it will be seen that container 12 is constructed so as to including a lid 22 that is screwable onto the main body portion of the container 12 and that has an upstanding wall 23 defining a space for receiving the straw positioning mechanism 20. Upstanding wall 23 has an inner surface 24 that is positioned, as may be seen in FIG. 2, to be frictionally engaged by the outer surface of the flexible straw 14 as the straw positioning mechanism 20 is moved between the first and second positions. This frictional engagement provides a controlled feel to the consumer during movement of the straw positioning mechanism 20. Upstanding wall 23 defines a portion of an opening 26 that is provided in the lid 22. Opening 26 is further defined by a downwardly extending, tube-like projection 48 having an inner surface 50 that defines a passage through which the flexible straw 14 extends, as will be described in greater detail below.

Figure 3:
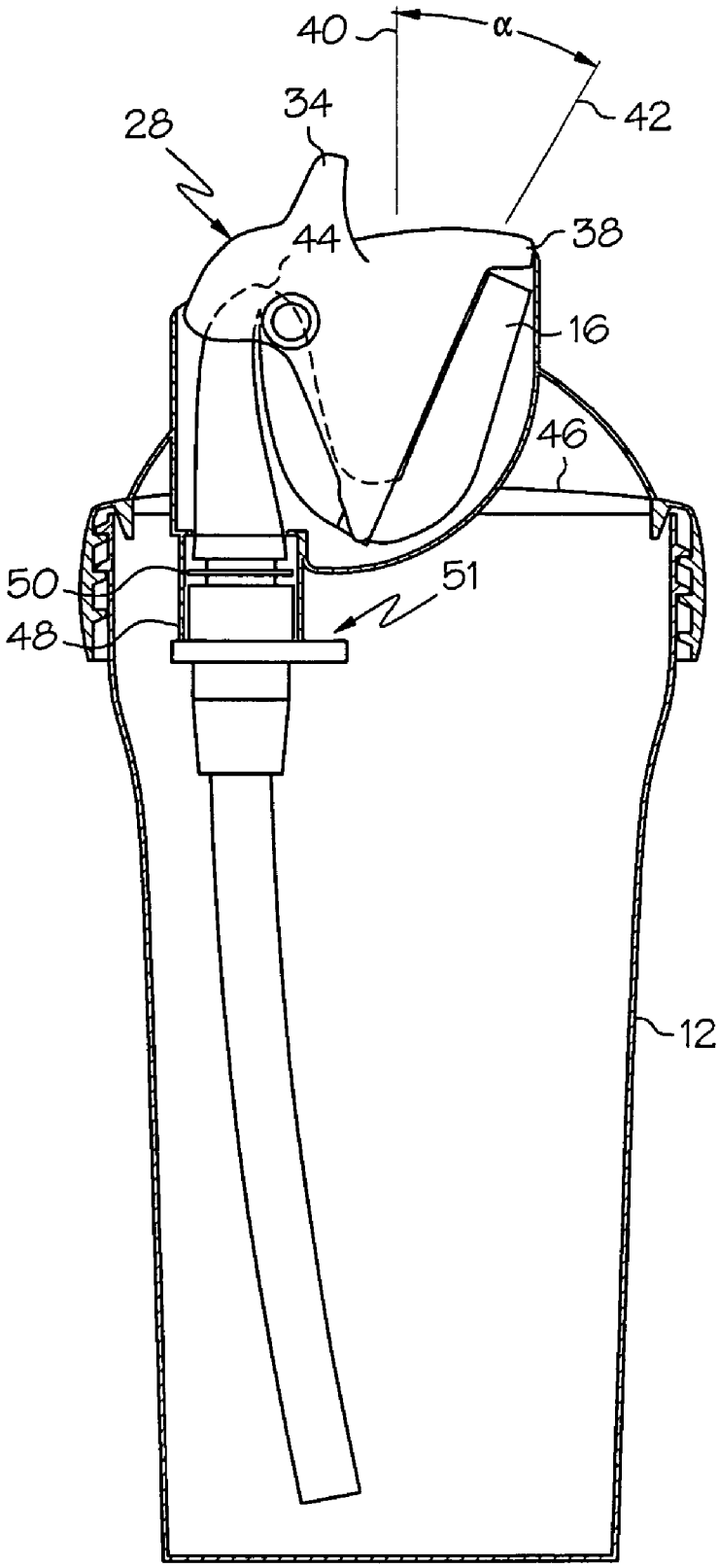
FIG. 3 is a partial cross-sectional view depicting a second operational position.
Figure 4:
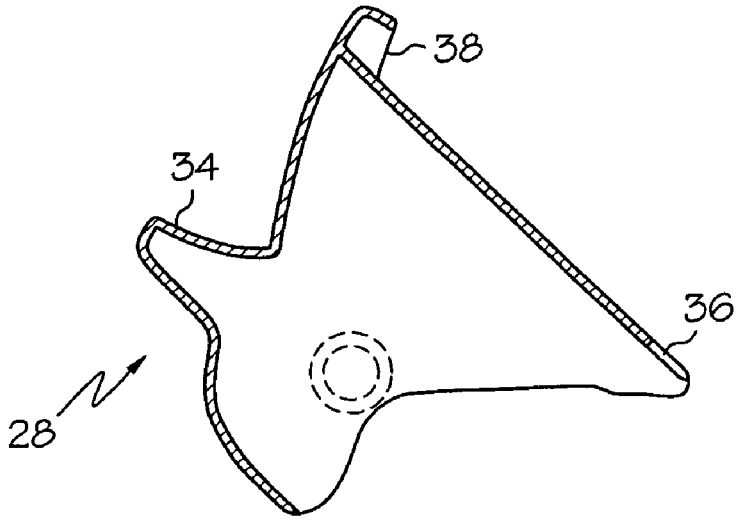
FIG. 4 is a cross-sectional view through one component of the straw drinking cup.

As may best be seen in FIGS. 2 and 3, straw positioning mechanism 20 is preferably embodied as a straw positioning member 28 that is pivotally mounted to the lid 22 and is substantially positioned within the opening 26 that is defined by the upstanding wall 23. Straw positioning member 28 includes a pair of axle projections 30 that are journaled into a corresponding pair of holes 32 that are defined in the upstanding wall 23, as shown in FIG. 1. Straw positioning member 28 preferably includes finger-gripping structure 34 for facilitating movement of the straw positioning member 28 by a consumer. In the preferred embodiment, finger-gripping structure 34 is an upstanding projection that may be contacted and pushed one way or another by a finger or a thumb of a consumer. Straw positioning member 28 preferably includes a downwardly extending arm 35 that has a recess 36 defined at its distal end for receiving the flexible straw 14. When the straw positioning mechanism 20 is in the second, closed position shown in FIG. 3, the flexible straw 14 will be bent into a horizontal S-shaped configuration by the downwardly extending arm 35 so as to be crimped in a first location 44 and also in a second location 46 that is adjacent to the recess 36. This minimizes the potential for leakage through the flexible straw 16 in the storage position, especially in conjunction with the venting mechanism 51 that will be described in greater detail below.

The inner surface 64 of the flexible straw 14 defines a first passage that is in communication with the container 12 for serving a beverage from the container 12. In operation, a consumer will suck on the drinking end 16 of the flexible straw 14, which will induce a pressure differential between the drinking end 16 and the second end 18 of the flexible straw 14. This, in turn, will draw the beverage upwardly through the flexible straw 14 into the mouth of the consumer. As may be seen in FIG. 5, which is a cross-sectional depiction of a portion of the flexible straw 14 that is part of the venting mechanism 51, the flexible straw 14 is circumferentially enlarged for a portion of its length into a plug portion 52 that has an outer surface 56 that is shaped and sized to fit snugly against the inner surface 50 of the tube-like projection 48 that partly defines the opening 26 in the lid 22 of the container 12. A number of longitudinal grooves 62 are defined in the plug portion 52 and together define a second, venting passage that is also in communication with the interior of the container 12. In the preferred embodiment, three longitudinal grooves 62 are provided in the plug portion 52 and are spaced evenly about the periphery of the plug portion 52. In the preferred embodiment, the lower end of the plug portion 52 is formed as a flange that includes a pull tab 66 for removing the flexible straw 14 from the lid 22. One or more radial grooves 68 are preferably defined in the upper face of the flange to insure adequate communication of the longitudinal grooves 62 with the interior of the container 12.

Figure 5:
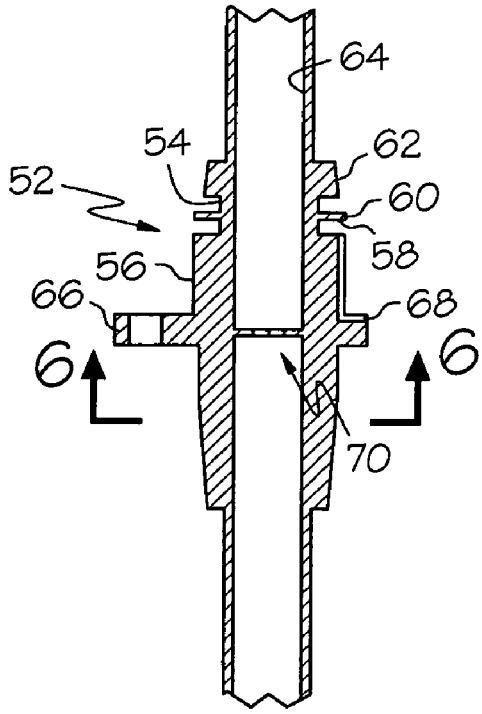
FIG. 5 is a fragmentary cross-sectional view through another component of the straw drinking cup.

As may be seen in FIG. 5, an annular recess 54 is defined in the plug portion 52, and a radially extending flexible membrane 58 is disposed in the annular recess 54. Flexible membrane 58 is sized so that its outer edge 60 will contact the inner surface 50 of the tube-like projection 48, thereby forming a seal that will, in the absence of a sufficient pressure differential to deflect the flexible membrane 58, prevent passage of air or liquid through the second passage or the individual longitudinal grooves 62. The flexible membrane 58 is engineered so that when a pressure differential of the magnitude that would be developed by a consumer sucking on the drinking end 16 of the flexible straw 14 is developed across the flexible membrane 58, the flexible membrane 58 will deflect, permitting replacement air to flow through the longitudinal grooves 62 and into the container 12. However, when the straw drinking cup 10 is not in use the flexible membrane 58 will act as a closed valve to prevent both air and liquid from escaping from the container 12.

Figure 6:
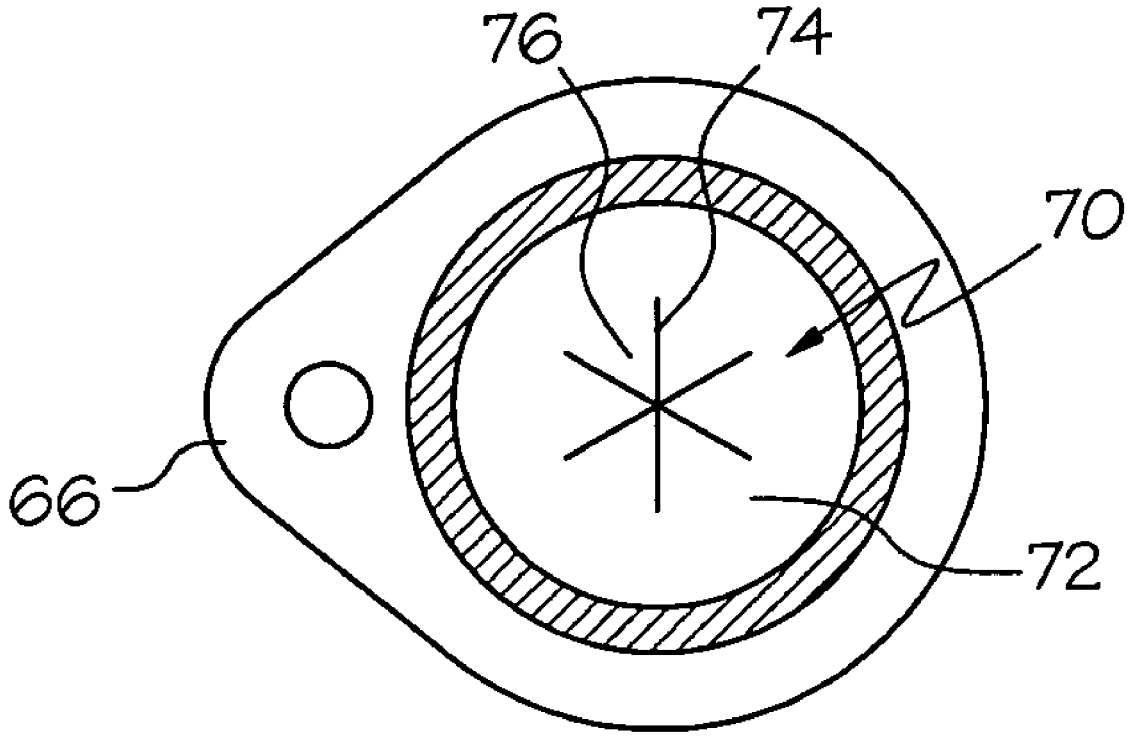
FIG. 6 is a cross-sectional view taken along lines 6-6 in FIG. 5.

Referring now to FIGS. 5 and 6, it will be seen that an integral internal valve 70 is further positioned within the flexible straw 14 for impeding fluid flow through the flexible straw 14 until a pressure differential of the magnitude that would be developed by a consumer sucking on the drinking end 16 of the flexible straw 14 is developed across the internal valve 70. As is best shown in FIG. 6, integral internal valve 70 is preferably constructed as an internal membrane 72 that is positioned across the lumen that is defined within the flexible straw 14. Internal membrane 72 is preferably molded with the flexible straw 14 so as to be unitary therewith. A plurality of slits 74 is defined within the internal membrane 72 in order to define a corresponding plurality of flap members 76. Flap members 76 are sized and shaped so as to deflect when a pressure differential of sufficient magnitude is applied across the internal membrane 72, thereby permitting fluid to flow through the internal valve 70.

The entire flexible straw 14, including the venting mechanism structure that is depicted in FIG. 5 and the internal valve 70, is preferably of unitary construction, and is preferably fabricated from a resilient elastomeric material such as silicone.

By crimping the flexible straw 14 in two different positions and through the provision of the flexible membrane 58 in the venting structure, straw drinking cup 10 is provided with triple redundancy against leakage when the straw positioning mechanism 20 is in the closed position. The flexible straw 14 will also tend to function as a toggle spring as the straw positioning mechanism 20 is moved between the two operative positions, as may be visualized in FIGS. 2 and 3. Because of the symmetrical construction of the flexible drinking straw 14, there is further no need to orient the flexible drinking straw 14 relative to the lid 22 during assembly.

When the straw drinking cup 10 is in the opening, drinking position, the unique orientation of the flexible straw 14 creates a flowpath that never allows both ends of the flowpath to be below the water level at any cup orientation. This, therefore, minimizes the potential of static leakage through the straw 14 in the open position, even in the event of valve failure. The flexible straw 14 in conjunction with the pivotal straw positioning structure 28 further provides a positive interlocking arrangement for positioning the straw 14, while minimizing the complexity of assembly with the other components.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An apparatus for serving a beverage, comprising:

a container;

a flexible straw in communication with said container for serving a beverage from said container, said flexible straw having a first end and a second end, an outer wall and an inner wall defining a lumen, an integral valve positioned within said flexible straw for impeding fluid flow through said lumen unless a pressure differential is applied thereto;

a second, venting, passage that is in communication with said container, wherein said second, venting passage comprises a space that is defined between an outer surface of said flexible straw and said opening that is defined in the container with at least a portion of said outer surface engages with at least a portion of said container; and a flexible membrane interposed in said second passage, said flexible membrane being constructed and arranged to permit air to flow through said second passage when a predetermined pressure differential is developed across said flexible membrane; and wherein said flexible straw comprises a circumferentially enlarged plug portion for securely fitting within said opening that is defined in said container, and wherein said second, venting passage comprises at least one longitudinal groove that is defined in said outer surface of said plug portion.

2. An apparatus according to claim 1, wherein said flexible membrane is integral with said flexible straw.

3. An apparatus according to claim 1, further comprising an annular recess that is defined in said circumferentially enlarged plug portion, and wherein said flexible membrane is positioned as a radially extending projection within said annular recess, said flexible membrane having a radially outer edge that is sized so as to contact a sidewall defined in said opening in said container.

4. An apparatus according to claim 1, wherein said second, venting passage comprises a plurality of said longitudinal grooves.

5. A straw drinking cup according to claim 1, wherein said flexible straw and said integral valve are fabricated from a single, unitary piece.

6. A straw drinking cup according to claim 5, wherein said single, unitary piece is fabricated from a material comprising silicone.

7. A straw drinking cup according to claim 5, wherein said integral valve comprises a membrane that is positioned within said straw so as to normally occlude fluid flow through said straw, and a plurality of slits that are defined in said membrane so as to define a plurality of flaps, said flaps being displaceable when a pressure differential is applied across said membrane in order to permit fluid flow therethrough.

8. A straw drinking cup according to claim 1, wherein said second, venting passage comprises multiple longitudinal grooves that are evenly spaced about the periphery of said plug portion.

9. A straw drinking cup according to claim 1, further comprising at least one radial groove that communicates with said longitudinal grooves.

10. A straw drinking cup according to claim 1, further comprising a tab located on an end of said plug portion for removing said flexible straw from a lid of said container.

11. An apparatus for serving a beverage, comprising:

a container;

a flexible straw in communication with said container for serving a beverage from said container, said flexible straw having a first end and a second end, an outer wall and an inner wall defining a lumen;

an integral valve positioned within said flexible straw for impeding fluid flow through said lumen unless a pressure differential is applied thereto;

a second, venting, passage that is in communication with said container, wherein said second, venting passage comprises a space that is defined between an outer surface of said flexible straw and said opening that is defined in the container; a flexible membrane interposed in said second passage, said flexible membrane being constructed and arranged to permit air to flow through said second passage when a predetermined pressure differential is developed across said flexible membrane;

wherein said flexible straw comprises a circumferentially enlarged plug portion for securely fitting within said opening that is defined in said container, and wherein said second, venting passage comprises at least one longitudinal groove that is defined in an outer surface of said plug portion; and further comprising an annular recess that is defined in said circumferentially enlarged plug portion, and wherein said flexible membrane is positioned as a radially extending projection within said annular recess, said flexible membrane having a radially outer edge that is sized so as to contact a sidewall defined in said opening in said container.

12. An apparatus for serving a beverage, comprising:

a container;

a flexible straw in communication with said container for serving a beverage from said container, said flexible straw having a first end and a second end, an outer wall and an inner wall defining a lumen;

an integral valve positioned within said flexible straw for impeding fluid flow through said lumen unless a pressure differential is applied thereto;

a second, venting, passage that is in communication with said container, wherein said second, venting passage comprises a space that is defined between an outer surface of said flexible straw and said opening that is defined in the container;

a flexible membrane interposed in said second passage, said flexible membrane being constructed and arranged to permit air to flow through said second passage when a predetermined pressure differential is developed across said flexible membrane;

wherein said flexible straw comprises a circumferentially enlarged plug portion for securely fitting within said opening that is defined in said container, and wherein said second, venting passage comprises at least one longitudinal groove that is defined in an outer surface of said plug portion; and further comprising at least one radial groove that communicates with said longitudinal grooves.

* * * * *